US005509654A

United States Patent [19]

Takemoto et al.

[11] Patent Number: 5,509,654

[45] Date of Patent: Apr. 23, 1996

[54] GAME MACHINE EMPLOYING METAL BODIES AS ITS MEDIA

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 193,659

[22] Filed: Feb. 7, 1994

Related U.S. Application Data

[63] Continuation of Ser. No. 910,024, Jul. 23, 1992, abandoned.

[30] Foreign Application Priority Data

Nov. 24, 1990 [JP] Japan ..... 2-320368

[51] Int. Cl.[6] ..... A63F 7/02

[52] U.S. Cl. ..... 273/121 B; 273/120 A

[58] Field of Search ..... 273/118 R, 118 A, 273/119 R, 119 A, 121 A, 121 B, 237, 238, 239, 120 A

[56] References Cited

U.S. PATENT DOCUMENTS

| | | | |
|---|---|---|---|
| 4,058,316 | 11/1977 | Miller . | |
| 4,927,145 | 5/1990 | Davis . | |
| 5,388,828 | 2/1995 | Takemoto et al. | 273/121 B |

FOREIGN PATENT DOCUMENTS

| | | |
|---|---|---|
| 507953A1 | 10/1992 | European Pat. Off. . |
| 51-19379 | 6/1976 | Japan . |
| 52-15354 | 2/1977 | Japan . |
| 60-20276 | 2/1985 | Japan . |
| 60-114283 | 6/1985 | Japan . |
| 60-188393 | 12/1985 | Japan . |
| 61-181480 | 8/1986 | Japan . |
| 63-210689 | 9/1988 | Japan . |
| 64-3506 | 1/1989 | Japan . |
| 2230463 | 10/1990 | United Kingdom . |

*Primary Examiner*—Jessica J. Harrison
*Attorney, Agent, or Firm*—Lowe, Price, LeBlanc & Becker

[57] ABSTRACT

A game machine of the present invention comprising a panel (11) including a game zone for movement of metal bodies of game media, a cover element (10*a*) covering the above-mentioned panel (11) so as to keep a space for movement of the metal bodies on the above-mentioned panel (11), and a mounting frame (38) on which the panel and cover element are mounted. This game machine further comprises a sensing matrix (20) comprised of matrix-arranged sensing units for metal body objects, and a signal processing portion which drives the sensing matrix (20) so as to detect positions of metal bodies on the panel (11). The signal processing portion having, at least in part thereof, a portion connected to the above-mentioned sensing matrix (20) arranged outside said game zone within a space defined by the mounting frame (38).

12 Claims, 13 Drawing Sheets

FIG. 7
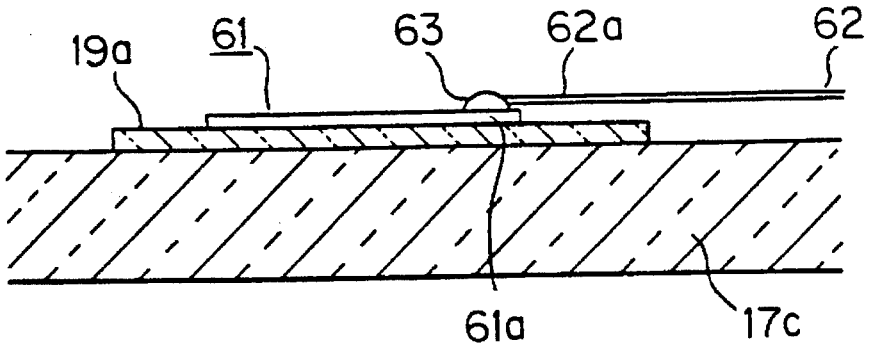
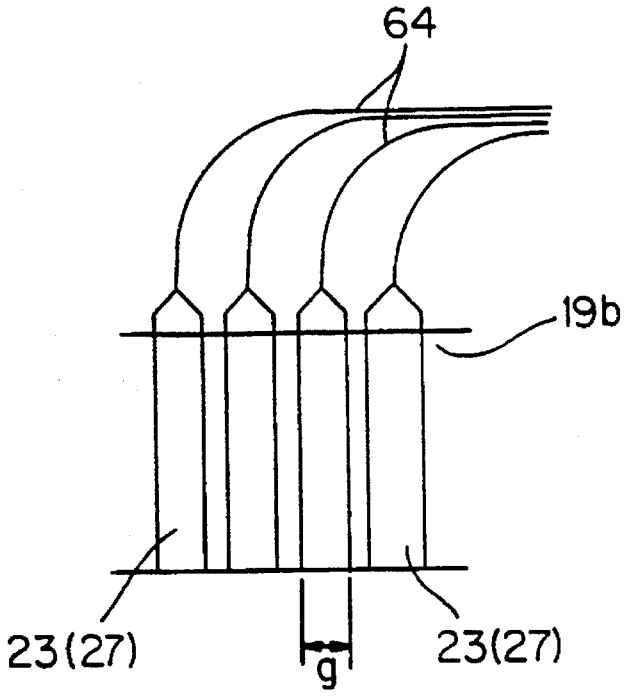
FIG. 8

GAME MACHINE EMPLOYING METAL BODIES AS ITS MEDIA

This application is a continuation of U.S. Ser. No. 07/910,024, filed Jul. 23, 1992, now abandoned.

TECHNICAL FIELD

The present invention relates to a game machine played with metal bodies. More particularly, it relates to a game machine which has a space defined between parallel planes wherein a metal body moves and scores when it enters specified holes.

BACKGROUND OF THE INVENTION

In some game machines which employ metal bodies as its media, a metal ball is moved within a specified space set for the game machine, and the receipt of a prize is determined in accordance with the movement of the ball. A typical example of such a game machine is, for example, a "pachinko" (Japanese upright pinball) game machine with which a game player causes a metal "pachinko" ball to move downward within a space between parallel planes provided with a large number of obstacles.

The "pachinko" game machine has a panel which defines the space for moving the "pachinko" ball, a glass plate which covers the panel at a fixed interval therefrom, and a projectile mechanism which project the "pachinko" ball to the upper part of the panel. The "pachinko" game machine is so installed that the panel extends in a substantially vertical direction. The panel is formed with a plurality of safe holes, each of which serves to make a hit when the "pachinko" ball has been led thereinto and driven out of the panel, and a single out hole into which the "pachinko" balls having failed to enter the safe holes are finally gathered to be driven out of the panel. A large number of pins (or nails) are placed on the panel protruding substantially perpendicularly thereto a distance corresponding to the diameter of each "pachinko" ball, so that the "pachinko" ball, as it falls along the panel may frequently collide with the pins thereby altering its moving direction. The pins are arranged on the panel in a predetermined distribution in which, while altering the moving direction of the colliding "pachinko" ball, they lead this ball to a safe hole in some cases and to miss a safe hole in other cases.

Owing to the construction as stated above, the "pachinko" game machines have individual characteristics, i.e., m some machines it is easy to register hits and in other machines it is difficult to register hits, depending upon the slight differences in the arrangement and inclinations of the pins. Even identical machines involve such differences as having safe holes with a high hit rate and safe holes with a low hit rate.

In a game center or the like wherein the game machines of this type are installed in large numbers, it is important to know the individual characteristics of the respective game machines as to management for profit administration and customer administration. If many of the machines register excessive hits the game center suffers a loss; whereas, if all the machines are difficult to register hits on, customers become disinterested, which is unfavorable to business. Accordingly, countermeasures need to be taken by knowing the individual characteristics of the respective game machines installed in the center.

For such a purpose, it is known to detect the moving courses of the "pachinko" balls in the "pachinko" game machine. In the official gazette of Japanese Patent Application Publication No. 3506/1989, for example, there is disclosed an apparatus equipped with an upper sheet and a lower sheet which have a pair of contacts. This technique senses the existence of the "pachinko" ball in such a way that the "pachinko" ball gets on the upper sheet and depresses it, whereby the pair of contacts touch.

With the prior-art apparatus, however, since the sheets have the pairs of contacts, they are restricted in arrangement, and they can be arranged only along the passages of the "pachinko" balls. It is therefore impossible to detect the motions of the balls from the point of view at which the whole panel is seen. The problem with this type of apparatus is that it is difficult to detect, for example, how the balls enter the safe holes and the out hole.

In addition, since the detection is based on the physical touching of the pair of contacts, sometimes the depression of the sheet becomes too weak to bring the pair of contacts into touch, so the motion of the ball is not detected. Besides, inferior touching can occur due to the wear, corrosion etc. of the pair of contacts. Further, the erroneous touching of the pair of contacts can occur by virtue of a vibration or the like or by chattering. For these reasons, the apparatus lacks reliability.

Another problem is that, since a pressure applied by the ball is utilized, the motion of the ball is delicately affected contrariwise.

Such problems can be encountered, not only in the "pachinko" game machine, but also in different machines. It is accordingly desired to overcome these problems.

On the other hand, when the sensor is arranged along the panel, there is a problem how to set a portion for detecting a metal body and a signal processing portion to drive the above-mentioned metal body detecting portion within the limited space without adverse effects, such as, for example, reducing a playing zone or obstructing a view or the like. This problem has not been considered heretofor.

DISCLOSURE OF THE INVENTION

An object of the present invention is to provide a game machine employing metal bodies as its media, according to which any location of the metal body within a specified space can be detected out of touch with the metal body and without employing contacts which require touching, whereby a detected result of high reliability is obtained.

Another object of the present invention is to provide a game machine employing metal bodies as its media, which can have a metal detecting portion and a signal processing portion which drives the metal detecting portion mounted inside a mounting frame without adversely affecting a game zone.

In order to accomplish the object, according to one aspect of the present invention, there is provided a game machine employing metal bodies as its media, characterized by comprising a panel having a plane which provides a game zone wherein metal bodies as media of a game move, a cover element which covers over the panel holding a space for the movement of metal bodies, a mounting frame in which said panel and said cover element are mounted, a matrix sensor configured by arranging a sensing unit in a matrix arrangement and mounted on the cover element for detecting the metal bodies without touching them, and a signal processing portion which drives the matrix sensor and detects the location of the metal bodies on the panel; and the signal processing portion has, at least in part thereof, a portion connected to the above-mentioned sensing matrix is arranged outside of the above-mentioned game zone within a space enclose by the mounting frame.

The above-mentioned signal processing portion may include, at least in the above-mentioned part thereof, a signal sending/receiving board loaded with at least a signal sending circuit for sending signals to drive the sensing matrix and a signal receiving circuit for receiving signals from the sensing matrix.

The above-mentioned signal sending/receiving board may be mounted on two corner portions of a side-end or lower-end of above-mentioned mounting frame.

The above-mentioned cover element may have an outside glass element placed to form a surface of a game machine and an inner glass element placed inside of it. In this case, it is preferable to mount the outside glass element and the inner glass element on the mounting frame keeping a space between them. The above-mentioned inner glass element may have a first and a second glass plate constituting the above-mentioned inner glass plate in layers.

The above-mentioned signal sending/receiving board may be arranged in the above-mentioned space between the outside glass element and the inner glass element.

The above-mentioned sensing matrix may be provided on the inner glass element.

The above-mentioned sensing matrix may also include a plurality of signal sending lines arranged in parallel and folded-back formation, and a plurality of signal receiving lines arranged in parallel and folded-back formation, and the signal sending lines and the signal receiving lines are arranged in the direction of intersecting each other holding the inner glass element therebetween, to form sensing units at the individual intersecting portion of the signal sending lines and signal receiving lines.

The signal sending lines and the signal receiving lines can be laid on the outer surfaces of the first and the second glass plates bonded each other in the direction of intersecting each other holding the first and the second glass plates.

The first and the second glass plates whereupon the signal sending lines and the signal receiving lines are laid may be covered, over their outer surfaces including the signal sending lines and the signal receiving lines, with protective sheets.

It also includes a signal sending connector connected to the signal sending lines, a signal receiving connector connected to the signal receiving lines, and a connector-mounting plate for fixing the above-mentioned connectors on it; the connector-mounting plate may be installed at a lower-end portion of the above-mentioned inner glass plate.

In the present invention, the sensing matrix having sensing units arranged in a matrix arrangement is installed at a cover element. Accordingly, every point of the panel covered with the cover element is placed under the monitoring of the sensing units in the matrix arrangement. A location of a presence of a metal body in a specified space, i.e., an arbitrary game zone can be detected. Moreover, since a non-touching sensing matrix that can detect a metal body without touching a metal body is employed, instead of employing a pair of contacts operable up physical contact, it can detect a metal body without touching, assuring highly reliable detection results.

In addition, part of the signal processing system for driving the sensing matrix which is connected to the sensing matrix is arranged in a space within the mounting frame and outside the game zone such as, for example, a lower-portion, a side-portion, a corner-portion or the like. Accordingly, it does not restrict the game zone and is inoffensive to the game player's eye.

BRIEF DESCRIPTION OF THE DRAWINGS

FIG. 7 is an enlarged sectional view of the signal sending line showing the connected state of a wire.

FIG. 8 is an enlarged front view of signal sending terminals.

DESCRIPTION OF THE INVENTION

Now, the first embodiment of the present invention will be described with reference to the drawings.

Figure 1:
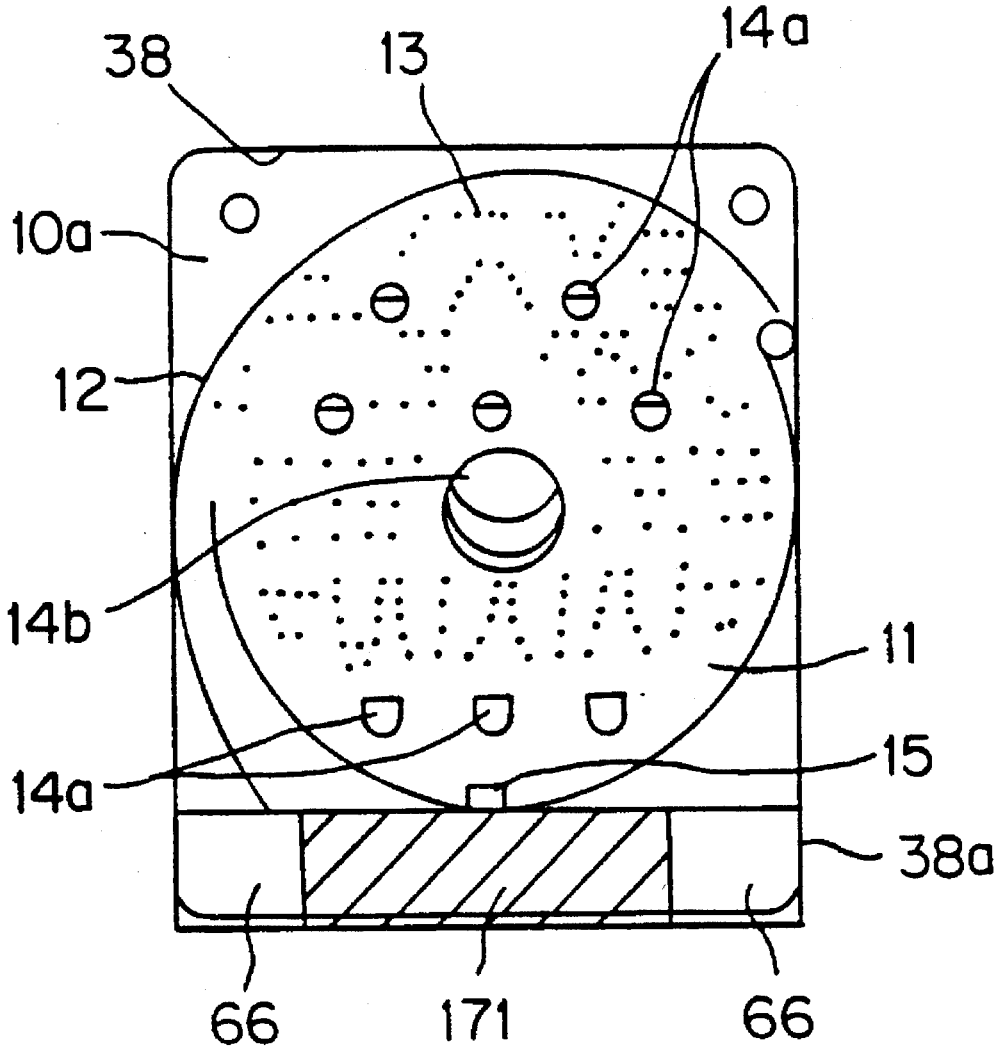
FIG. 1 is an explanatory view showing a general configuration of a first embodiment of a game machine of the present invention.
Figure 2:
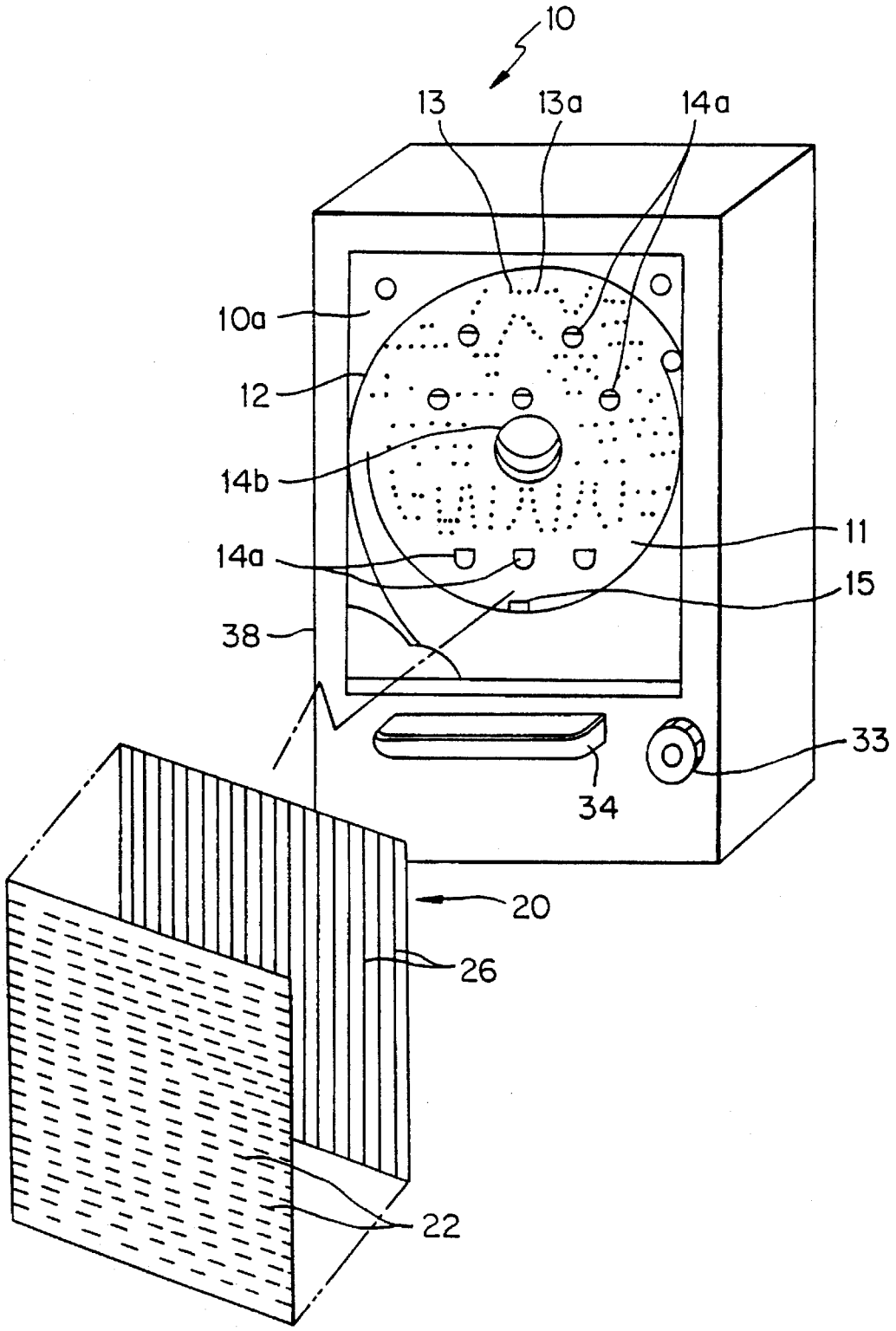
FIG. 2 is a conceptually exploded isometric view showing the game machine and the sensing matrix.
Figure 3:
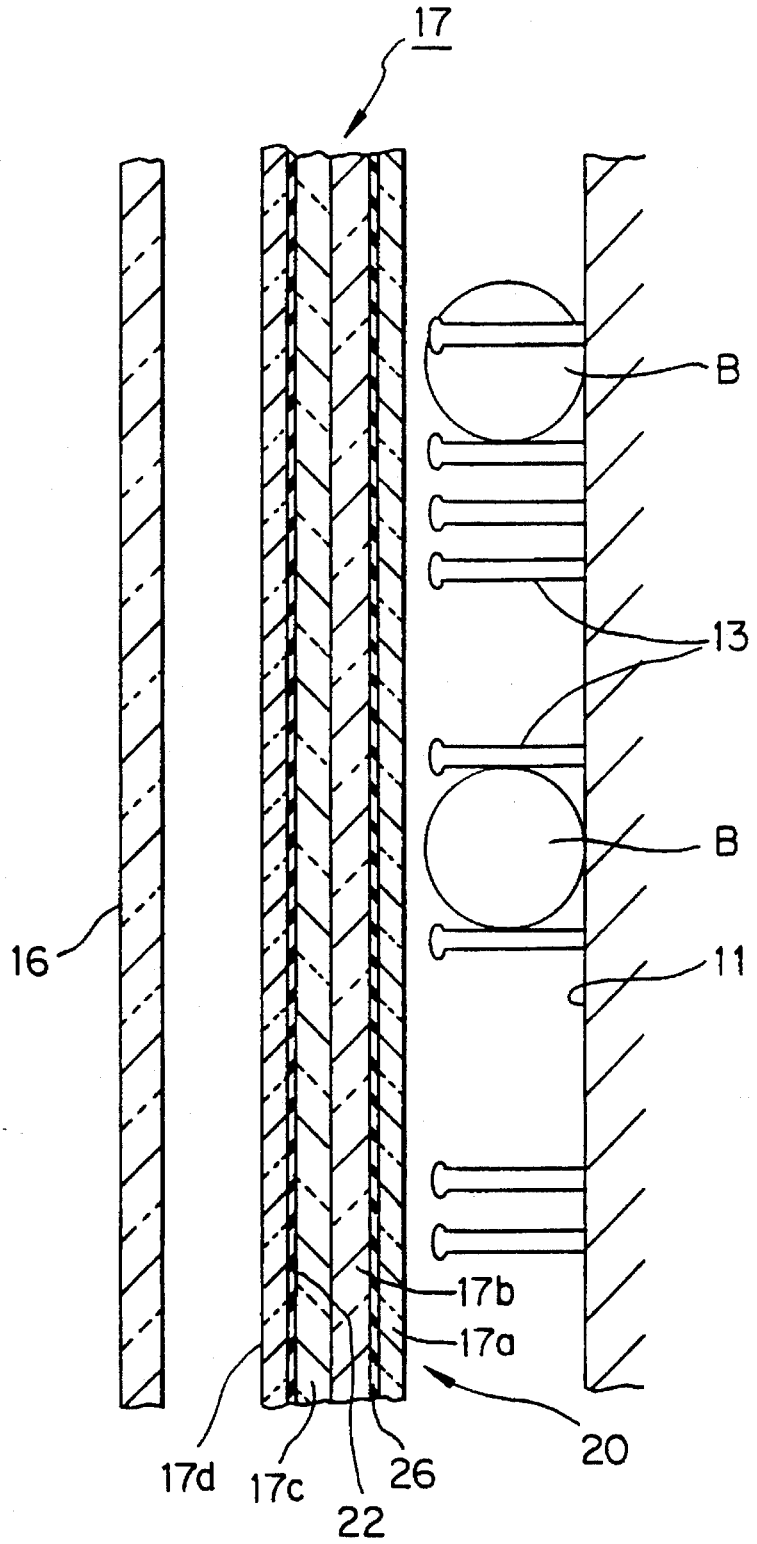
FIG. 3 is a vertical sectional view of part of the game machine.

As shown in FIGS. 1, 2 and 3, the game machine 10 includes a panel 11 which defines a space for moving a metal ball B, a glass cover 10*a* which covers the panel 11 with a fixed interval held therebetween, a projectile mechanism which serves to project the metal ball B toward the upper part of the panel 11, and a mounting frame 38 wherein these parts stated above are installed. This game machine 10 is so installed that the panel 11 extends substantially in the vertical direction.

A guide rail 12 for defining a game region is mounted on the panel 11 of the game machine 10. A domain inside the guide rail 12 is the game region. A large number of pins (or nails) 13, 13, . . . for repelling the metal ball B are planted and erected on the part of the panel 11 within the game region. In addition, a plurality of 'safe' holes 14*a*, 14*a*, . . . are provided in various places, and a single 'out' hole 15 is provided at the lower end of the game region.

As depicted in FIG. 3, the pins 13 are erected to be substantially perpendicular in the state in which each pin protrudes from the panel 11 by a length corresponding to the diameter of the metal ball B. Besides, the pins 13 are arranged so that the metal ball which falls along the panel 11 while passing between the pins 13, 13 may frequently collide against the large number of pins 13 existent in its traveling course, thereby having its direction of movement changed. More specifically, as depicted in FIG. 2, at least two of the pins 13 gather to form a pin line or pin group 13*a*. Such pin lines or pin groups 13*a* have their distribution determined in such a manner that, while having its direction of movement altered, the colliding metal body may be led so as to proceed toward the safe hole 14*a* in some cases or to miss the safe hole 14*a* in other cases, depending upon the projected position of the metal body, namely, the fall starting point thereof, the moving direction and speed thereof on that occasion, and so on.

The safe hole 14*a* is a hole which serves to make a hit when the metal body enters it and is driven out of the panel 11. On the other hand, the out hole 15*a* is a hole into which the metal bodies having failed to enter any of the safe holes 14*a* are finally collected to be driven out of the panel 11.

The front glass cover 10*a* covering the panel 11 has a double structure composed of a front glass element 16 and an inner glass element 17.

The projectile mechanism includes a striking handle 33, and a drive mechanism not shown. The handle 33 is mounted at the front of the game machine 10, and is used for the operation of striking or knocking the metal body. The striking operation is effected by rotating the handle 33 a desired angle.

Also, a tray 19 for receiving the metal bodies delivered by the game machine 10 is mounted at the front of this game machine. A predetermined number of metal bodies are awarded as a prize when the metal body projected to the panel 11 has entered any of the safe holes 14*a*.

Figure 4:
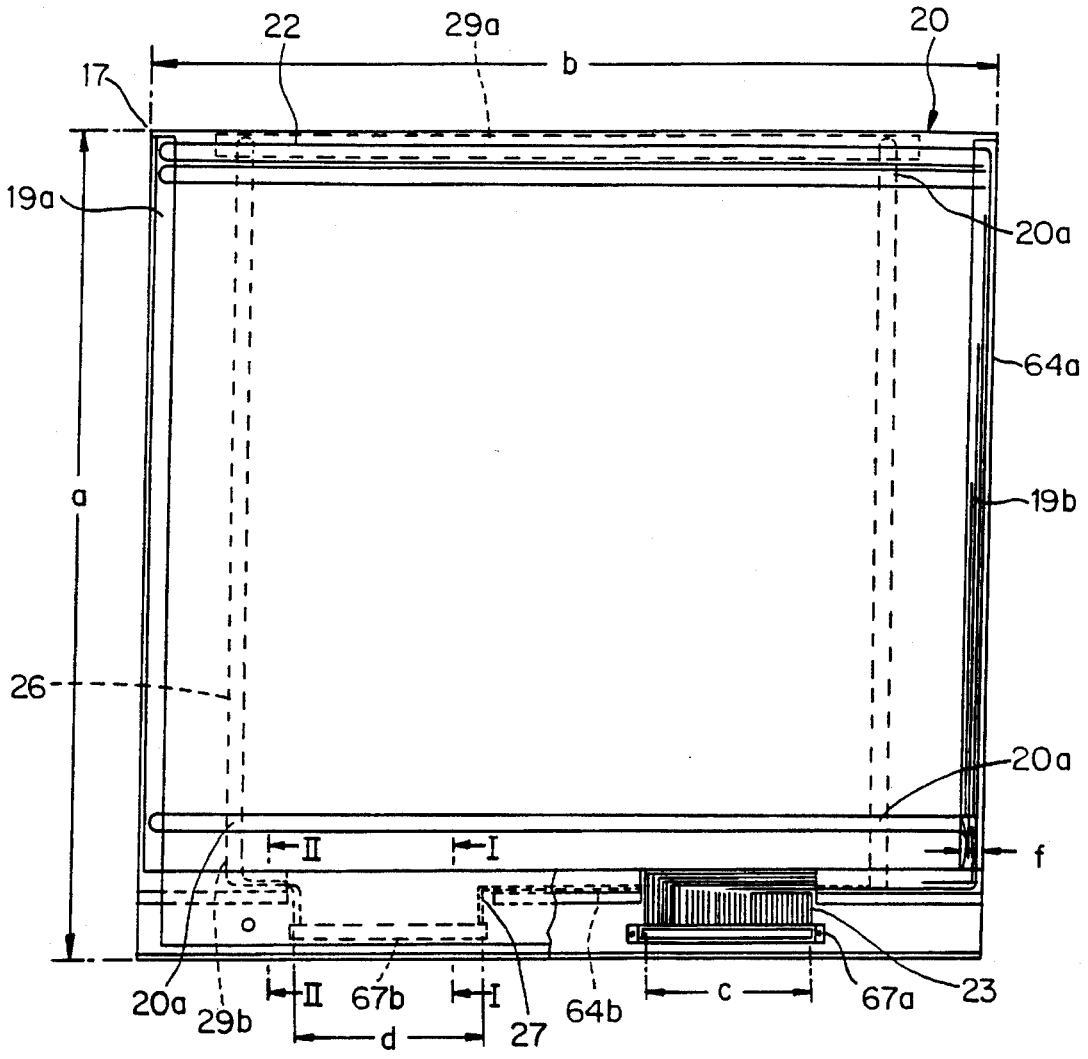
FIG. 4 is a front view of the sensing matrix.

As shown in FIG. 3, a sensing matrix 20 is formed by using the inner glass element 17 arranged along the panel 11 holding a certain space as a base plate. As shown in FIG. 4, the sensing matrix 20 includes a plurality of signal sending lines 22 and a plurality of signal receiving lines 26. The plurality of signal sending lines 22 are arranged on one surface of the inner glass element 17 in parallel unidirectionally. Likewise, the plurality signal receiving lines 26 are arranged on the opposite surface of the inner glass element 17 in parallel unidirectionally. Each of the signal sending lines 22 is U-turned at a turning portion 61 into a folded-back formation (or a loop shape) in parallel. Similarly, each of the signal receiving lines 26 is U-turned into a folded-back formation (or a loop shape) in parallel. Signal sending terminals 23 and signal receiving terminals 27 are concentratedly arranged at a lower end in relation to an inner glass element 17 which is attached to the game machine.

Each signal receiving line 26 is laid close enough to the individual signal sending lines 22 to be electromagnetically coupled with them. The signal receiving lines 26 have their plane in parallel with the plane of the signal sending lines 22 and are extended in the direction intersecting orthogonally to the extending direction of these lines 22 in order that their electromagnetic characteristics may be changed by the approach of a metal body. The signal sending lines 22 and the signal receiving lines 26 constitute a sensing matrix 20.

In the front view of FIG. 4, individual square parts enclosed with the intersecting signal sending lines 22 and signal receiving lines 26 form sensing units 20*a*, 20*a*, . . . each of which senses the metal body.

Figure 5A:
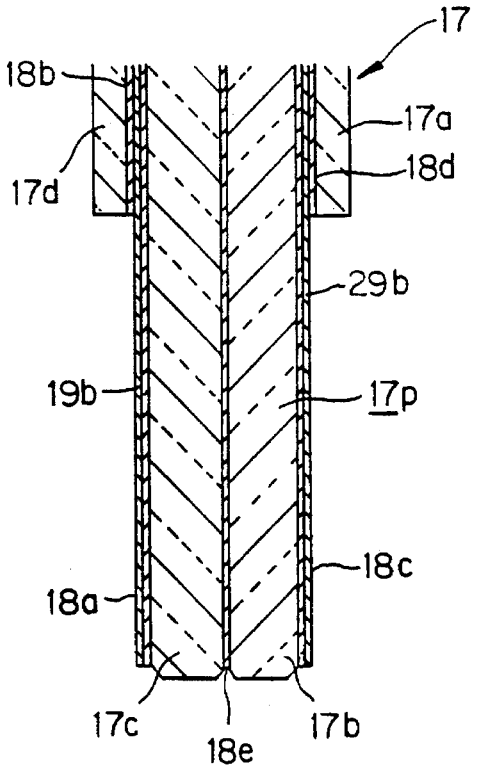
FIG. 5A is an enlarged sectional view of an inner glass element which includes the sensing matrix.
Figure 5B:
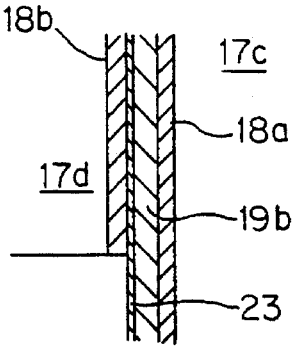
FIG. 5B is an enlarged view of a circular portion enclosed with a broken line in FIG. 5A.

FIG. 5A shows an enlarged sectional view of the inner glass element 17, and FIG. 5B shows an enlarged view of a circular part enclosed with a broken line in FIG. 5A.

The inner glass element 17 is constructed by stacking four layers; an inner protective glass plate 17*a* which is a protective sheet for the signal receiving lines 26 (shown in FIG. 4), a glass base plate 17*b* on a signal receiving side, a glass base plate 17*c* on a signal sending side, and an outer glass plate 17*d* which is a protective sheet for the signal sending lines 22 (shown in FIG. 4). The inner glass element (front glass) 17 is a glass base plate in a square shape that its three representative dimensions are; the length a is 367 [mm]±10[mm], the width b is 405 [mm]±10 [mm], and the thickness is 3.0~3.5 [mm]. The inner protective glass plate 17*a* and the outer glass plate 17*d* are vertically shorter than the signal-receiving-side glass base plate 17*b* and the signal-sending-side glass base plate 17*c* and as a result, the inner glass element 17 is exposed at its lower end 17*p*.

The plurality of signal receiving lines 26 in the parallel folded-back formation are sandwiched between the inner protective glass plate 17*a* and the signal-receiving-side glass base plate 17*b*. The plurality of signal sending lines 22 in the parallel folded-back formation are laid in a manner so as to be sandwiched between the signal-sending-side glass base plate 17*c* and the outer glass plate 17*d*. Accordingly, the inner glass element 17 is fabricated in such a way that the signal sending lines 22 are laid on one surface of the signal-sending-side glass base plate 17*c* by bonding them with a transparent binder layer 18*a*, the outer glass plate 17*d* is bonded on the signal sending lines with a transparent binder layer 18*b*, the signal receiving lines 6 are laid on the other surface of the signal-receiving-side glass base plate 17*b* by bonding them with a transparent binder layer 18*c*, the inner protective glass plate 17*a* is bonded on the signal receiving lines with a transparent binder layer 18*d*, and the other surface of the signal-sending-side glass base plate 17*c* and the other surface of the signal-receiving-side glass base plate 17*b* are bonded together by the use of a transparent binder layer 18*e*.

A transparent conductor film for shielding the sensing matrix is provided on the entire front surface of the outer glass plate 17*d* lying in front of the plurality of signal sending lines 22. This transparent conductor film is formed of any of an indium-tin oxide (I. T. 0.) film, a tin oxide film, etc.

Figure 6:
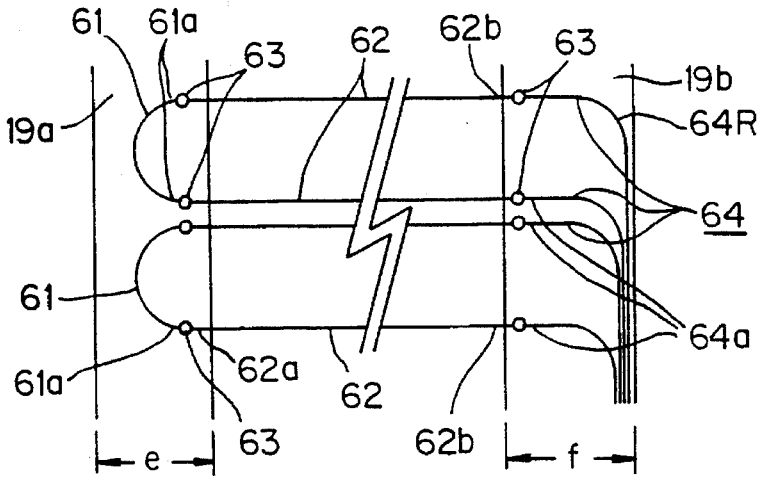
FIG. 6 is a front view showing a detailed layout of signal sending lines.

As illustrated in FIG. 4, the signal-sending-side glass base plate 17*c* in a square shape has a signal-sending-side turning circuit board 19*a* bonded thereto along one vertical latus thereof, the circuit board 19*a* being formed of an elongate flexible printed-wiring circuit board (FPC), and a signal-sending-side circumventing circuit board of an L shape 19*b* bonded thereto along the opposite vertical latus thereof and part of the bottom latus thereof, the circuit board 19*b* being similarly formed of a flexible printed-wiring circuit board. The signal-sending-side turning circuit board 19*a* is such that, as shown in FIG. 6, a plurality of arcuate turning portions 61, specifically, 32 of them, are formed in a row by a conductor pattern made of copper foil, and that, as shown in FIG. 7, one end 62*a* of each piece of wire 62 is connected to one end 61a of the corresponding turning portion 61 by welding or soldering with solder 63.

FIG. 8 shows an enlarged view of a circular part enclosed with a broken line in FIG. 4. As depicted in FIG. 8, the signal sending terminals 23 of which there are a plurality, specifically there are 64, and which extend vertically for external connections are formed of a conductor pattern made of copper foil, on the lower-end edge of the signal-sending-side circumventing circuit board 19*b* opposite the turning circuit board and along part of the lower-end latus.

As shown in FIG. 5A, the signal sending terminals 23 are arranged at the lower end 17*p* of the inner glass element 17 and are exposed due to the fact that they are not concealed by the outer glass plate 17*d*. That is, the outer glass plate 17*d* is bonded on the surface part of the signal-sending-side glass base plate 17*c* bearing the signal sending lines 22, except the part thereof bearing the signal sending terminals 23. On the terminal side of each of the signal sending lines 22, there are the signal sending terminal 23 of the corresponding signal sending line 22 and a circumventive portion 64 for this signal sending terminal 23. The circumventive portions 64 for leading the signal sending lines to the signal sending terminals 23 are formed of a conductor pattern on the signal-sending-side circumventing circuit board 19*b*, and are laid along this signal-sending-side circumventing circuit board 19*b* from the corresponding signal sending terminals 23.

While being tensed, the wire piece 62 extending from the end 61*a* of each of the turning portions 61 has its other end 62*b* connected to the start point 64*a* of the corresponding circumventive portion 64 on the terminal side by welding or soldering with a solder 63, whereupon the end 62*b* is connected to the signal sending terminal 23 through the circumventive portion 64. Incidentally, regarding the circumventive portions 64, two straight parts are connected using round parts in order to eliminate any high-frequency problems.

Similarly, the signal-receiving-side glass base plate 17*a* in a square shape has a signal-receiving-side turning circuit board 29*a* bonded thereto along one lateral top latus thereof, and it also has an elongate signal-receiving-side circumventing circuit board 29*b* bonded thereto along part of the lateral bottom latus thereof. Likewise to the signal-sending-side turning circuit board 19*a*, the signal-receiving-side turning circuit board 29*a* is such that a plurality of arcuate turning portions 61, specifically, 32 of them, are formed of a conductor pattern made of copper foil, and that one end 62*a* of each piece of wire 62 is connected to one end 61*a* of the corresponding turning portion by welding or soldering with solder 63.

Figure 9:
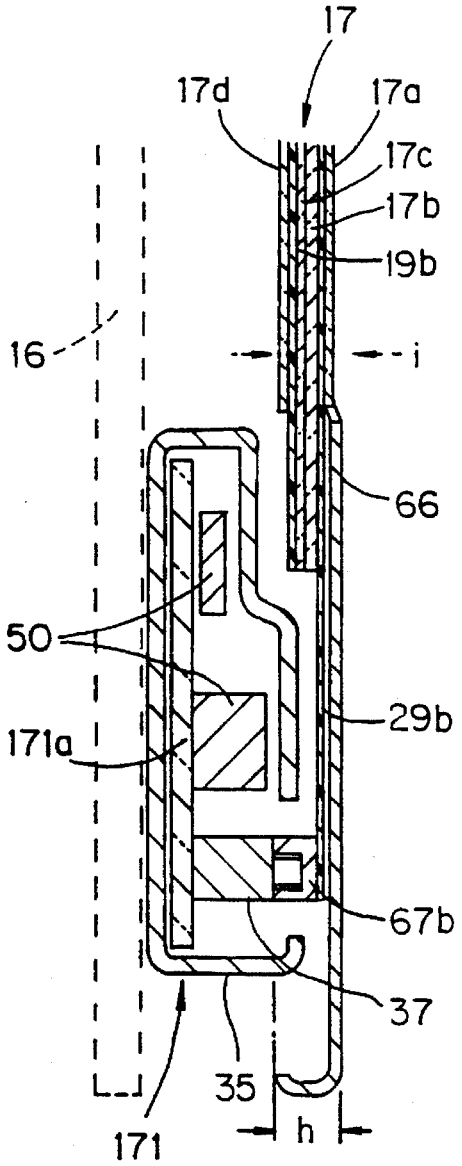
FIG. 9 is a sectional view along line I—I of the sensing matrix in FIG. 4.

As shown in FIG. 9, a lower end part of the signal-receiving-side circumventing circuit board 29*b* opposite the turning circuit board is projected, and the plurality of signal receiving terminals 27 which extend vertically for external connections are formed of a conductor pattern made of copper foil, on the lower-end edge of the signal-receiving-side circumventing circuit board 29*b* opposite the turning circuit board and along part of the lower-end latus. These signal receiving terminals are located at non-confronting positions at which they do not overlap the signal sending terminals when the signal-receiving-side glass base plate 17*b* is bonded to the signal-sending-side glass base plate 17*c*. The number of the signal receiving terminals 27 is, for example, 64. On the terminal side of each of the signal receiving lines 26, there are the signal receiving terminal 27 of the corresponding signal receiving line 26 and a circumventive portion 64 for this signal receiving terminal 27. The circumventive portions 64 for leading the signal receiving lines to the signal receiving terminals 27 are formed of a conductor pattern on the signal-receiving-side circumventing circuit board 29*b*, and are laid along this signal-receiving-side circumventing circuit board 29*b* from the corresponding signal receiving terminals 27.

While being tensed, the wire piece 62 extending from the end 61*a* of each of the turning portions 61 has its other end 62*b* connected to the start point 64*a* of the corresponding circumventive portion 64 on the terminal side by welding or soldering with solder 63, whereupon the end 62*b* is connected to the signal receiving terminal 27 through the circumventive portion 64.

In this manner, each of the signal sending lines 22 or the signal receiving lines 26 is made up of the turning portion 61 which is formed on the corresponding turning circuit board 19*a* or 29*a*, the circumventive portions 64 which are formed on the corresponding circumventing circuit board 19*b* or 29*b*, the wire pieces 62, and the signal sending terminal 23 which forms the end part of the signal sending line 22 or the signal receiving terminal 27 which forms the end part of the signal receiving line 26.

Incidentally, the surface of each wire piece 62 has a delustered black color and prevents the reflection of light in order to be inoffensive to the game player's eye.

The pattern of the sensing matrix 20 suitable for the ordinary game machine 10 is one which has the signal sending lines 22 in 32 rows and the signal receiving lines 26 in 32 columns, so that there are a total of 1024 sensing units 20*a*. Incidentally, in FIG. 4, the patterns except the outer part thereof are omitted from illustration.

The diameter of the wire of which each of the signal sending lines 22 and signal receiving lines 26 is formed is preferably set at a value of 25 mm~30 mm. In this embodiment, the entire widths c and d of the signal sending terminals 23 and signal receiving terminals 27 as indicated in FIG. 4 are respectively set at 126 mm, and the widths e and f of the vertically-extending parts of the signal-sending-side turning circuit board 19*a* and signal-sending-side circumventing circuit board 19*b* as indicated in FIG. 6 are respectively set at 10 mm or less.

Besides, the width g of each of the signal sending terminals 23 and signal receiving terminals 27 as indicated in FIG. 8 is 1.5 mm.

Figure 10:
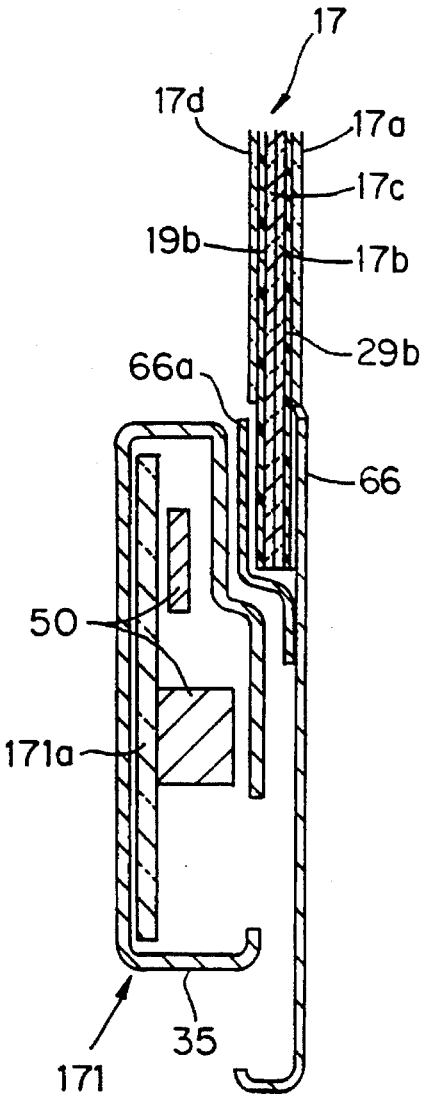
FIG. 10 is a sectional view along line II—II of the sensing matrix in FIG. 4.

In addition, as shown in FIGS. 9 and 10, a connector-mounting plate 66 is installed at the lower part of the inner protective glass plate 17*a* of the inner glass element 17. A connector-mounting plate 66 is fixed to the inner glass element 17 as if the plate is a part of the element by sandwiching the end part 17*p* of the inner glass element 17 at its both side with a fixing part 66*a*. The connector-mounting plate 66 extending downward along the inner glass element 17 is made of plastics or stainless steel, and has the same width as the inner glass plate 17. As depicted in FIG. 4, a signal sending connector 67*a* and signal receiving connector 67*b* are fixed on the connector-mounting plate 66 at positions corresponding to the signal sending terminal 23 or the signal receiving terminal 27, respectively.

The signal sending connector 67*a* is connected to the signal sending terminals 23 of the individual signal sending lines 22. The signal receiving connector 67*b* is connected to the signal receiving terminals 27 of the individual signal receiving lines 26. The thickness of the connector-mounting plate 66 is thickest at a position whereupon the signal sending connector 67*a* and the signal receiving connector 67*b* are provided. The thickness h of this part of the plate is set as almost the same as or slightly thinner than the thickness i of the inner glass element 17 including the outer glass plate 17*d* and inner protective glass plate 17*a*. Accordingly, the signal sending connector 67*a* and the signal receiving connector 67*b* of which the heights are low enough to satisfy the condition stated above are employed.

A matrix I/O sending/receiving board 171 is provided between a surface glass element 16 and the sensing matrix 20. As shown in FIG. 1, the matrix I/O sending/receiving board 171 is installed long sideways at the center of a lower-end portion 38*a* of the mounting frame 38 where the panel 11 is not covered with it (depicted as a shaded portion). The size of the matrix I/O sending/receiving board 171 is 350 [mm]×40 [mm] in this embodiment.

The matrix I/O sending/receiving board 171 includes a mounting base plate 171*a* made of a printed-wiring circuit board and a matrix I/O case 35 which encases the mounting base plate 171*a*. A signal sensing circuit 40 for sending signals to the plurality of signal sending lines 22 of the sensing matrix 20, a signal receiving circuit 50 for receiving signals from the plurality of signal receiving board 26, and a joint connector 37 being connected to the signal sending connector 67*a* and the signal receiving connector 67*b* are installed on the mounting base plate 171*a*.

The signal sending connector 67*a* and the joint connector 37 connected each other are to connect the signal sending terminal 23 to the signal sending circuit 40, and the signal receiving connector 67*b* and the joint connector 37 connected each other are to connect the signal receiving terminal 27 to the signal receiving circuit 50.

In addition, the matrix I/O sending/receiving board 171 may well be formed with a plurality of the mounting base plates 171*a*.

The signal processing portion employed for detecting the metal body in the game machine of this embodiment, is as shown in FIGS. 11~16.

Figure 11:
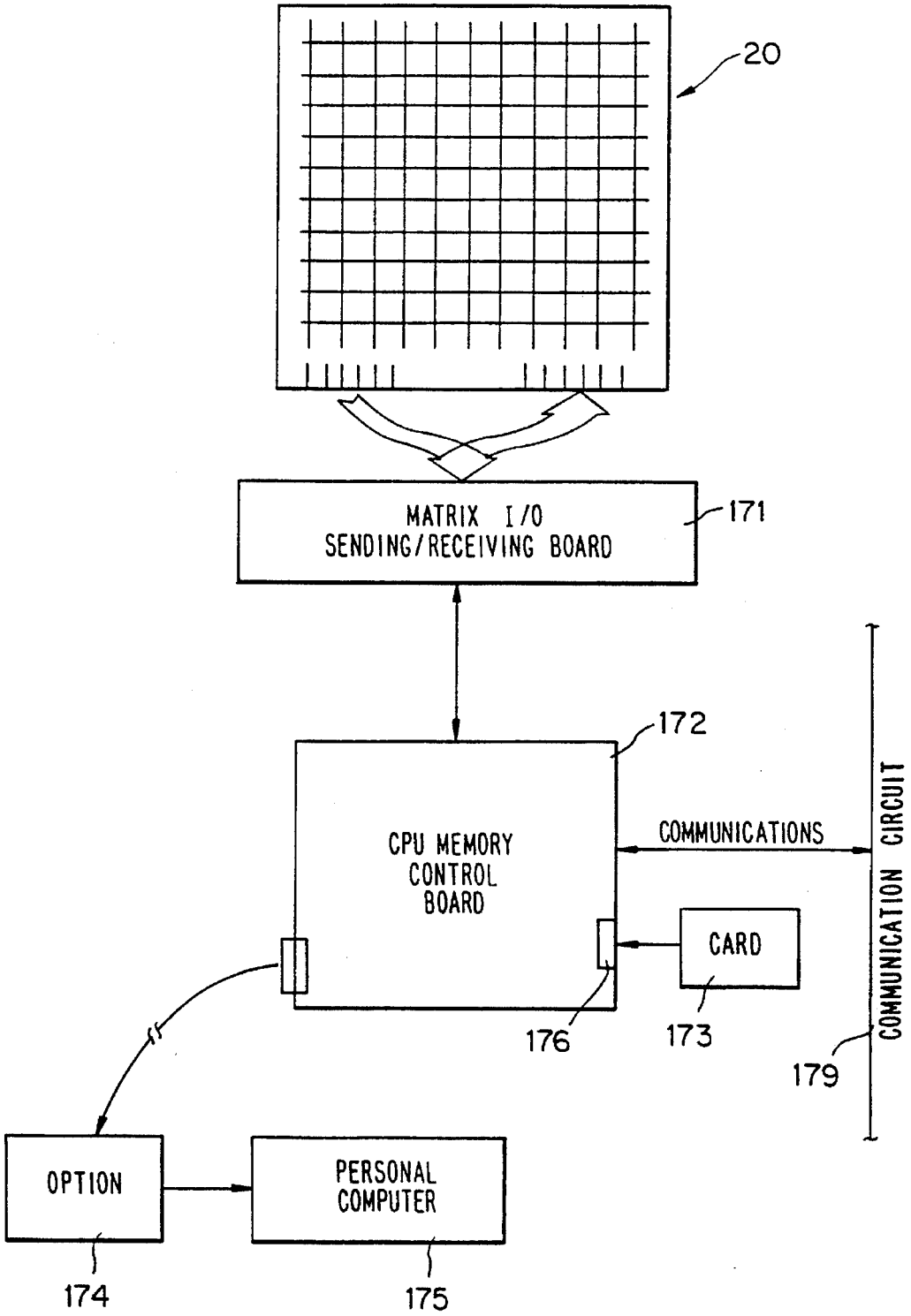
FIG. 11 is a block diagram showing an example of the construction of a hardware for use in one embodiment of a sensor for detecting a location of the presence of a metal body according to the present invention.

As illustrated in FIG. 11, the sensing matrix 20 is under the control of a CPU memory control board 172 through a matrix I/O sending/receiving board 171. The CPU memory control board 172 forms a data processing system, and the board is capable of communication by means of a communication circuit 179. Besides, the CPU memory control board 172 has an interface portion 176 for enabling a control unit 30 to read the monitor points from a card 173.

The card 173 is a memory card for the monitor memory which is detachably set in the interface portion 176. It stores therein data indicative of the monitor points for the metal body, and it allows the data to be read therefrom. The card 173 is stored therein data indicative of the positions of safe holes 14*a*, 14*a*, . . . , a metal body detection position, and an out hole 15 that are installed on the panel of the game machine 10; and an algorithm for detecting the metal body entering any of the safe holes 14*a*, 14*a*, . . . and out hole 15; etc. as monitor data. In addition, a RAM card, a mask ROM, an EPROM, an one-shot ROM, or the like can be employed as a card.

An option 174 connected to the CPU memory control board 172 is a storage for recording the moving courses of the metal bodies on a moving route between the inner glass element 617 and the panel 11 of the game machine 10. The option 174 may well employ a storage employing a disk-type of recording medium such as an optical disk, an optical-magnetic disk, etc. or a storage employing a tape-type of recording medium such as an analog or digital recording tape recorder, a video tape recorder, etc. In addition, another computer system can also be employed. Further, a storage employing a solid recording medium such as a semi-conductor memory can also be employed. In addition, when the option of this embodiment is applied to a game machine, it is preferable to employ small one with a large capacity. It is because in a time zone in which the number of the game players increases, the activity rate of each game machine 10 heightens, and hence, an enormous storage capacity is required.

The recorded data in the option is processed and operated by a computer incorporated a software for analysis of the data into the moving courses of the metal bodies, then the data needed in a game center can be obtained.

The matrix I/O sending/receiving board 171 includes the signal sending circuit 40 and the signal receiving circuit 50. The signal sending circuit 40 is a circuit which sends signals of predetermined frequency to the individual signal sending lines 22 sequentially, while the signal receiving circuit 50 is a circuit which receives signals from the individual signal receiving lines 26 sequentially in synchronism with the signal sending circuit 40. Suitable as a voltage waveform to be applied to the signal sending lines 22 by the signal sending circuit 40 is a continuous sinusoidal wave which has a frequency of 1~1.3 [MHz] and which centers at 0 [V].

Figure 12:
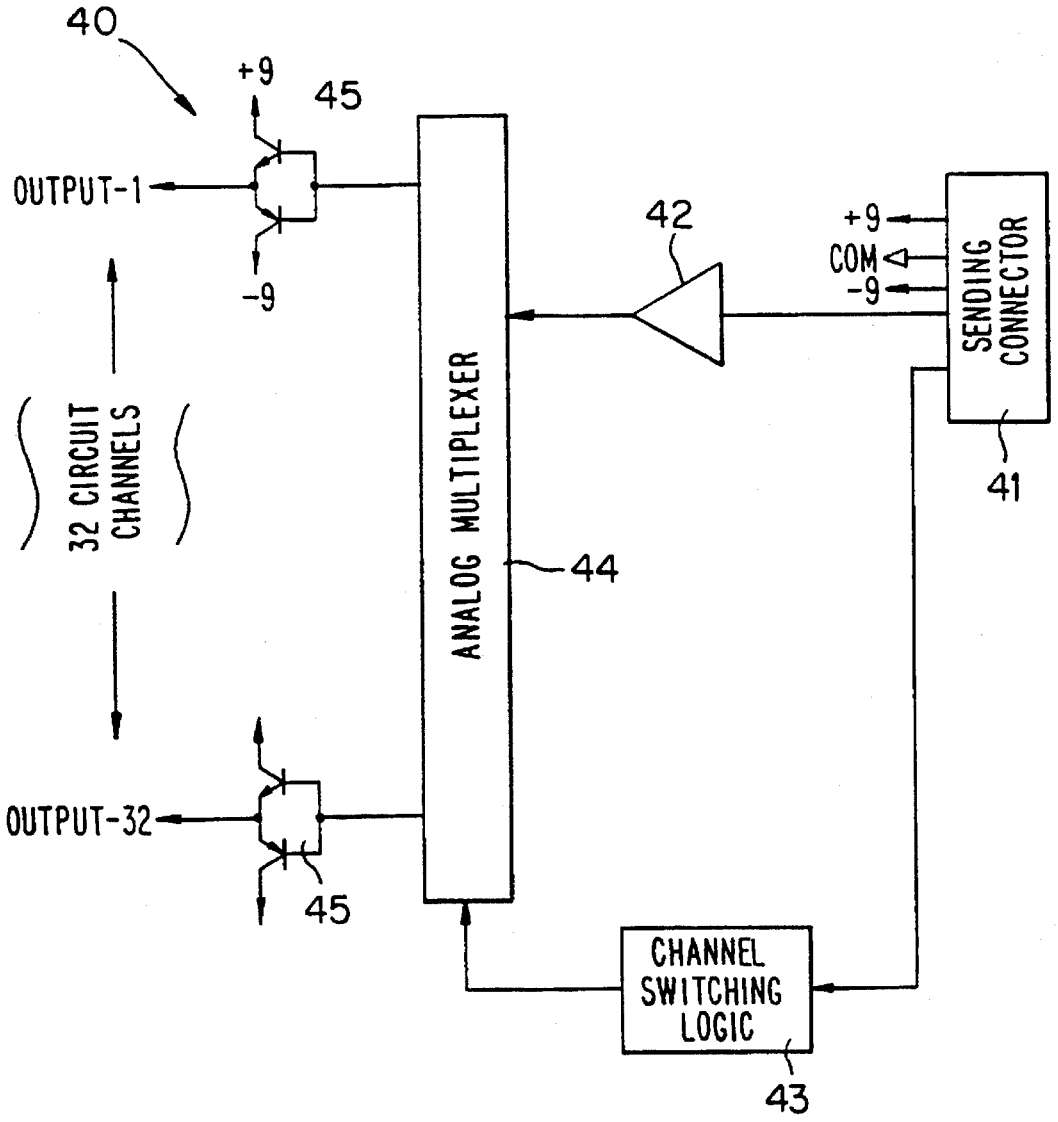
FIG. 12 is a block diagram of a signal sending circuit in a matrix I/O sending/receiving board included in the above-mentioned hardware.

As shown in FIG. 12, the signal sending circuit 40 is formed with a signal sending connector 41, an amplifier 42 and channel switching logic 43 which are connected to the signal sending connector 41, an analog multiplexer 44 which is connected to both the amplifier 42 and the channel switching logic 43, and a plurality of totem-pole drivers of PNP and NPN transistors 45 which are all connected to the analog multiplexer 44 and which are respectively connected through the signal sending connector 67*a* to the sides of the signal sending lines 22 in the plural circuit channels, specifically, 32 circuit channels.

Figure 13:
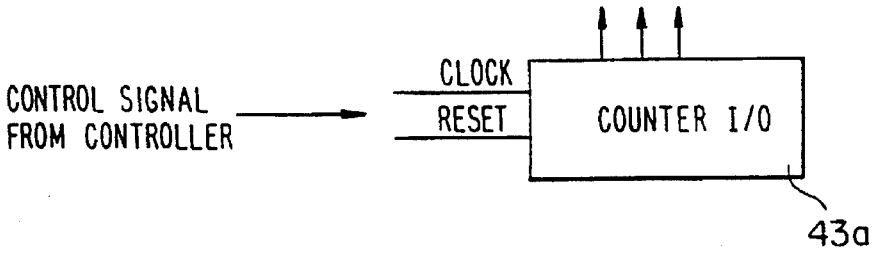
FIG. 13 is a block diagram showing the principal part of a channel switching logic included in the above-mentioned hardware.

As shown in FIG. 13, the channel switching logic 43 is operated with two, clocking and resetting control signals by effectively utilizing a counter IC 43*a*.

Figure 14:
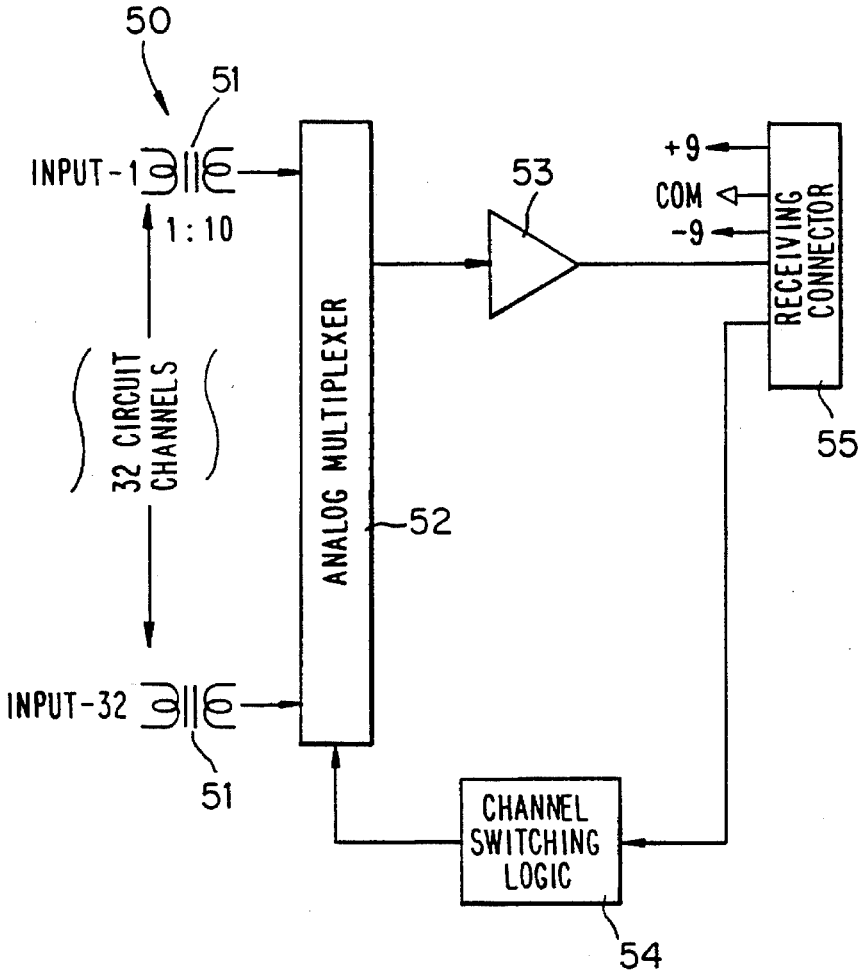
FIG. 14 is a block diagram of a signal receiving circuit in the matrix I/O sending/receiving board included in the above-mentioned hardware.

As shown in FIG. 14, the signal receiving circuit 50 is configured of 32 CT (current transformers) 51, an analog multiplexer 52 which is connected to the CT 51, an amplifier 53 and channel switching logic 54 which are connected to the analog multiplexer 52, and a signal receiving connector 55 which is connected to both the amplifier 53 and the channel switching logic 54. The CT 51 are respectively connected through the signal receiving connector 67*b* to the sides of the signal receiving lines 26 of 32 circuit channels. Accordingly, the signal receiving circuit 50 receives signals through each of the CT 51 from the individual signal receiving lines 26.

Each of the CT 51 isolates the corresponding signal receiving line 26 from the analog multiplexer 52, and amplifies a signal from the signal receiving line 26 by 10 times. The analog multiplexer 52 receives signals through the individual CT 51 sequentially, and the amplifier 53 amplifies a signal from the analog multiplexer 52. The channel switching logic 54 is a component which is similar to the channel switching logic 43 of the signal sending circuit 40.

Figure 15:
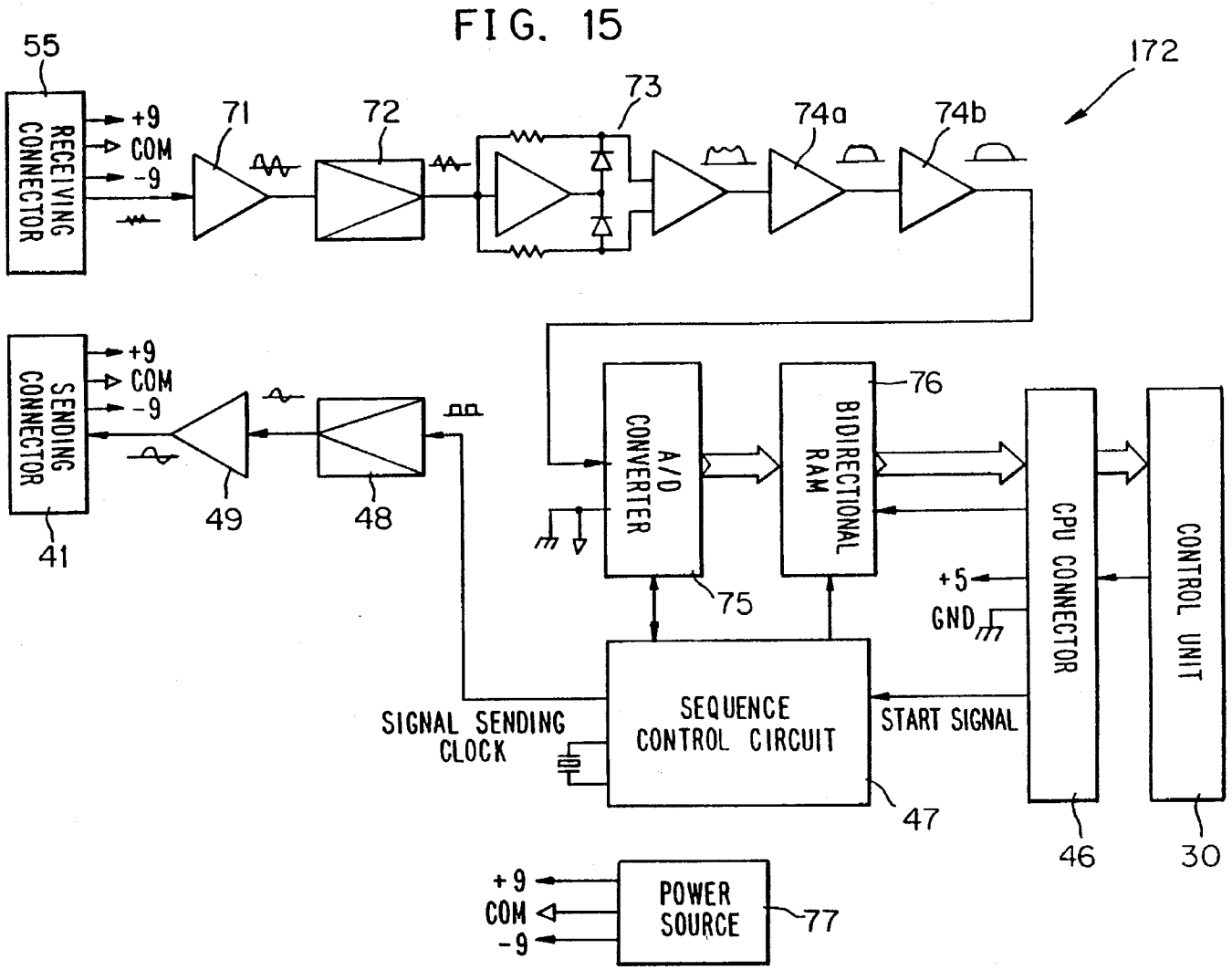
FIG. 15 is a block diagram of signal receiving and signal sending circuits in a CPU memory control board included in the above-mentioned hardware.

As shown in FIG. 15, the CPU memory control board 172 is furnished on the signal sending side thereof with a CPU connector 46 which is connected to a control unit 30, a sequence control circuit 47 which produces signal sending clock pulses in response to a start signal applied through the CPU connector 46 by the control unit, a band-pass filter 48 which accepts the signal sending clock pulses and delivers signals to-be-sent, and an amplifier 49 which amplifies the signals to-be-sent and delivers the amplified signals to the signal sending connector.

In addition, the CPU memory control board 172 is furnished on the signal receiving side thereof with an amplifier 71 which amplifies received signals from the signal receiving connector 55, a band-pass filter 72 which accepts the amplified signals, a full-wave rectifier/amplifier 73 which accepts the received signals from the band-pass filter 72, two stages of low-pass filters 74*a* and 74*b* which accept the received signals from the full-wave rectifier/amplifier 73, an A/D converter 75 which accepts the received signals from the low-pass filter 74*b* and delivers digital data to a bidirectional RAM 76 under the control of the sequence control circuit 47, and the bidirectional RAM 76 which accepts the digital data, writes the received data under the control of the sequence control circuit 47 and delivers the received data to the control unit 30 through the CPU connector 46 in response to a read signal from this CPU connector 46.

The bidirectional RAM 76 is a memory for recording the value of a signal from the signal receiving circuit 50 as detection data at every sensing unit 20*a* configured by the individual signal sending lines 22 and the individual signal receiving lines 26, and includes therein a counter, which executes all the processing of the matrix data of the metal bodies. Further, the CPU memory control board 172 is furnished with a power source unit 77.

The control unit 30 is to read the data of the monitor area in the card 173 and the detection data in the bidirectional RAM 76, and monitor metal bodies by checking up the detection data with the data of the monitor area of the metal body.

Next, the operation of this embodiment will be described.

Address signals and control signals from the control unit 10 are transmitted to the game machine 10 via the CPU connector 46.

In the game machine 10, on the signal sending side, the sequence control circuit 47 accepts the start signal and divides the frequency of a crystal oscillation clock at a value of 16 [MHz] as is needed, thereby delivering the signal sending clock. The signal sending clock from the sequence control circuit 47 is subjected to waveshaping from the digital signal into the analog signal by the band-pass filter 48. Thereafter, the analog signal is amplified by the amplifier 49 and is delivered to the signal sending connector 41.

Further, the sending signal is amplified by the amplifier 42 in the signal sending circuit 40. The analog multiplexer 44 actuates the totem-pole drivers 45 sequentially in the channels changed-over by the channel switching logic 43. Thus, the totem-pole drivers 45 deliver the signals amplified by the amplifier 42, to the signal sending lines 22 sequentially at predetermined cycles (refer to a step 91 in FIG. 16).

In the sensing matrix 20, a signal of predetermined frequency is sent sequentially to the plurality of signal sending lines 22 which have a folded-back formation from the signal sensing circuit 40, and an alternating magnetic field is generated. An electromotive force is generated by the mutual induction in the signal receiving lines 26 which are electromagnetically coupled with the above-mentioned signal sending lines 22. An eddy current is produced in the surface of the metal body and in the direction of canceling a magnetic flux based on the sensing matrix 20 when the metal body comes near the sensing unit 20*a* on such occasions. Since the magnetic flux changes by the effect of the eddy current, the magnitude of an induced current appearing in the signal receiving line 26 at the pertinent position becomes smaller.

On the signal receiving side, the signal receiving circuit 50 synchronizes with the signal sending circuit 40 by the sequence control circuit 47, and receives signals from the individual signal receiving lines 26 through each of the CT 51. As indicated in FIG. 14, currents being electromagnetic characteristic values which appear on the plurality of signal receiving lines 26 are amplified by 10 times by means of the CT 51. Since the CT sensors 51 are employed for the amplification, the gain of the amplifier on the signal receiving side need not be heightened accordingly. The CT 51 isolate each of the signal receiving lines 26 of the sensing matrix 20 constructing a metal sensor from the analog multiplexer 52 of the signal receiving circuit 50 for preventing the intrusion of the noise from the game machine 10 into the signal receiving circuit 50, and amplifies the received signals.

The analog multiplexer 52 is a circuit in which the signals accepted from the individual signal receiving lines 26 via the CT 51 are changed-over in accordance with the channel switching logic 54 and then delivered sequentially at predetermined cycles. The signals from the analog multiplexer 52 are amplified by 100 times by means of the amplifier 53 (refer to a step 92 in FIG. 16).

Each of the received signals is amplified and detected via the signal receiving connector 55, amplifier 71 and band-pass filter 72. The received signal from the band-pass filter 72 is an analog signal. The analog signal is waveshaped by the full-wave rectifier/amplifier 73. The signal from the full-wave rectifier/amplifier 73 is averaged by integration processing by means of the low-pass filter 74*a*, 74*b*.

Subsequently, the received signal is delivered to the A/D converter 75. The A/D converter 75 converts the signal from the sensing matrix 20 into a digital signal of a predetermined number of bits, for example, a 12-bit unit, and it records the detected data in the bidirectional RAM 76 under the control of the sequence control circuit 76 (refer to a step 93 in FIG. 16). The speed of this processing is as high as 25000 times per second. After the bidirectional RAM 76 has recorded the detected data irrespective of the operation of the control unit 30 in response to a write signal delivered from the sequence control circuit 63, it increments the address by one upon inputting one clock pulse (refer to a step 94 in FIG. 16). The capacity of the bidirectional RAM 76 is, for example, 2048 bytes.

Figure 16:
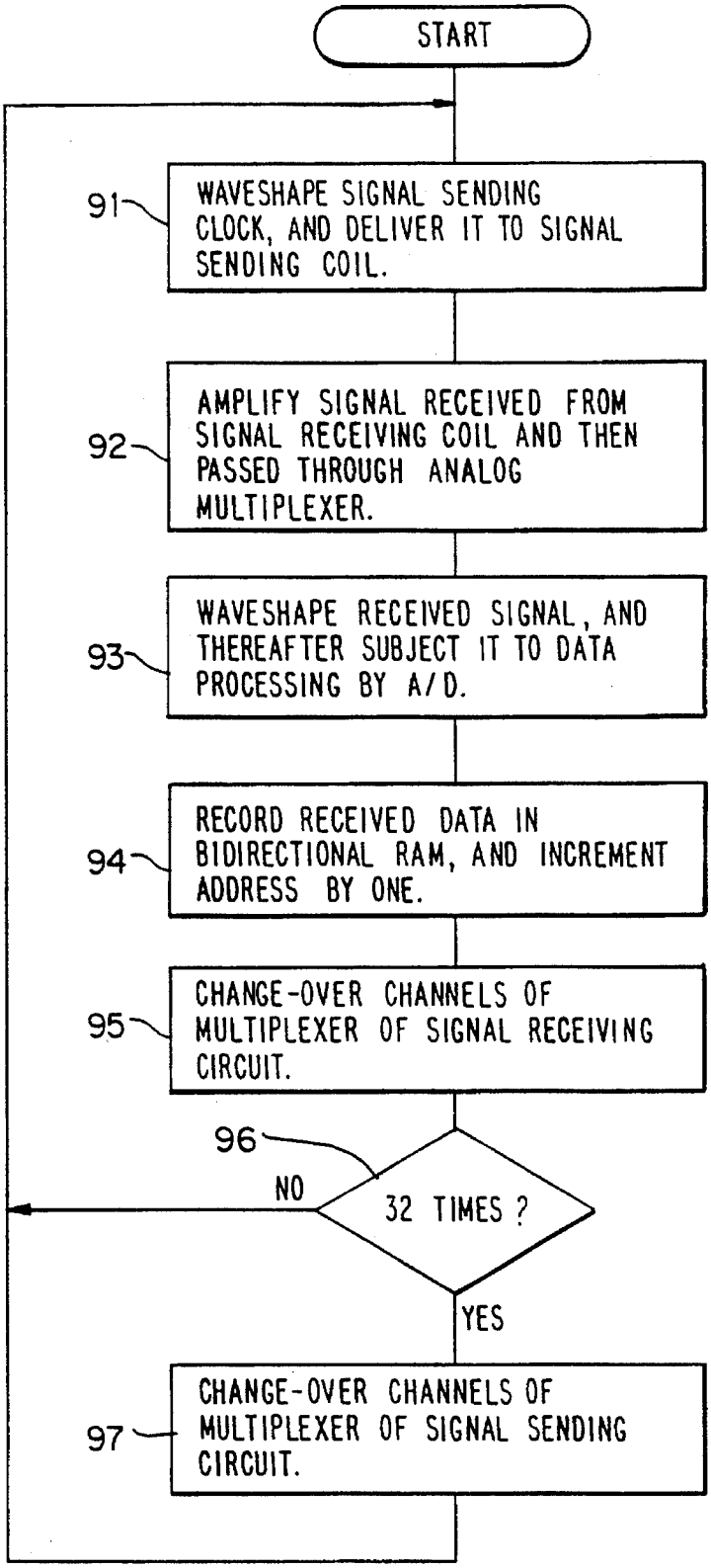
FIG. 16 is a flow chart of the scanning of the sensing matrix in this embodiment.

Next, the analog multiplexer 52 of the signal receiving circuit 50 changes-over the signals from the individual signal receiving lines 26 (refer to a step 95 in FIG. 16) until the above steps are repeated 32 times in correspondence with the 32 signal receiving lines 26 (refer to a step 96 in FIG. 16). After the steps have been repeated 32 times, the analog multiplexer 44 of the signal sending circuit 40 changes-over the signal sending lines 22 (refer to a step 97 in FIG. 16), whereupon the signal processing is repeated again.

Accordingly, the positions of the metal bodies of the sensing matrix 20 can be grasped as the coordinates of the positions where the signal receiving lines 26 in which the received signal has changed intersect with the signal sending lines 22, 22, . . . sent the signal thereto on such occasions which are detected by the scanning operations. The total number of the sensing units 20*a* is 1024 in conformity with the signal sending lines 22 in the 32 rows and the signal receiving lines 26 in the 32 columns. Therefore, no matter which of the safe holes 14*a* and the out hole 15 in the panel 11 the metal body may pass through, it can be detected.

The bidirectional RAM 76 memorizes the position of the metal bodies in the sensing matrix 20 as the detected data of the sensing unit 20*a* made with the individual signal sending lines 22 and the individual signal receiving line 26 processed from the intersecting position of the signal receiving line 26 in which the received signal has changed on the basis of the signal from the signal receiving circuit 50 and the signal sending line 22 sent the signal on such occasion.

According to the necessity, the control unit 30 reads the detected data concerning the position of the metal bodies recorded in the bidirectional RAM 76 on the basis of the reading start signal and executes the operation, then it monitors metal bodies by checking up the detected data with the monitor data of the metal bodies memorized in the card 173.

The control unit 30 repeats this processing. The sensing matrix 20 can pursue the motion of metal bodies projected and struck onto the panel 11 of the game machine 10 as the change of the coordinates. In the game machine 10, the progress of the game can be monitored by detecting the moving courses of the metal bodies projected and struck onto the panel on a moving route by means of the sensing matrix 20. It can check an unfair practice, for example, by detecting an abnormal moving course of projected metal bodies. As unfair practices, for example, there is an intentional change of the direction of the movement of metal bodies from the outside of the machine with a magnet or the like. In addition, by counting the metal bodies entered into the safe holes, it is possible to find out a game machine in which the metal bodies abnormally tend to enter into the safe holes. Since it gives bad influence to the management of a game center to leave such machines working, it is necessary to stop such a machine. Therefore, it is important to check whether there is any safe hole that metal bodies are abnormally liable to enter thereinto.

In a case where the situation in which the metal bodies enter the safe holes is to be monitored in the game machine 10 of new type, the card 173 may be exchanged in conformity with the type. Since the card 173 can easily set the monitor data by inserting it to the interface portion 176 of the data processing system, it is easy to alter the monitor data even when it is to be applied to a large number of types of game machines for reasons of replacement of the game machines, or the like. As long as the game machines 10 of the same type are concerned, the cards 173 can be fabricated by copying a single card. Moreover, the card 173 is versatile, so that when more complicated processing is to be executed, it can be coped with by selecting the control unit of the suitable data processing speed at will.

Incidentally, regarding the control unit 30, when the algorithm for detecting the metal body is simple, the use of an inexpensive 8-bit CPU suffices, and when the required algorithm is complicated, a 16-bit CPU may well be selected for executing high-speed processing. In either case, the rate of the scanning of the metal body is not affected by the CPU because the CPU is not concerned in the scanning.

In addition, since the matrix I/O sending/receiving board 171 provided the signal sending circuit 40 and signal receiving circuit 50 is mounted on the lower-end portion 38, it does not obstruct the panel 11 of the game machine 10, and a sense of incongruity given by it to the game player's eye is slight.

Regarding the sensing matrix 20, the signal sending connector 67*a* and signal receiving connector 67*b* are readily detached from the joint connector 37, so that the sensing matrix 20 having become out of order can be easily exchanged by detaching the inner glass element 17 from the matrix I/O sending/receiving board 171. Also, the sensing matrix 20 can be easily installed on a game machine of the type in which this sensing matrix 20 is not packaged.

Next, the second embodiment of the present invention will be described. The same parts and/or portions as those of the first embodiment have the same numeral and symbols assigned thereto, and shall not be repeatedly explained.

Figure 17:
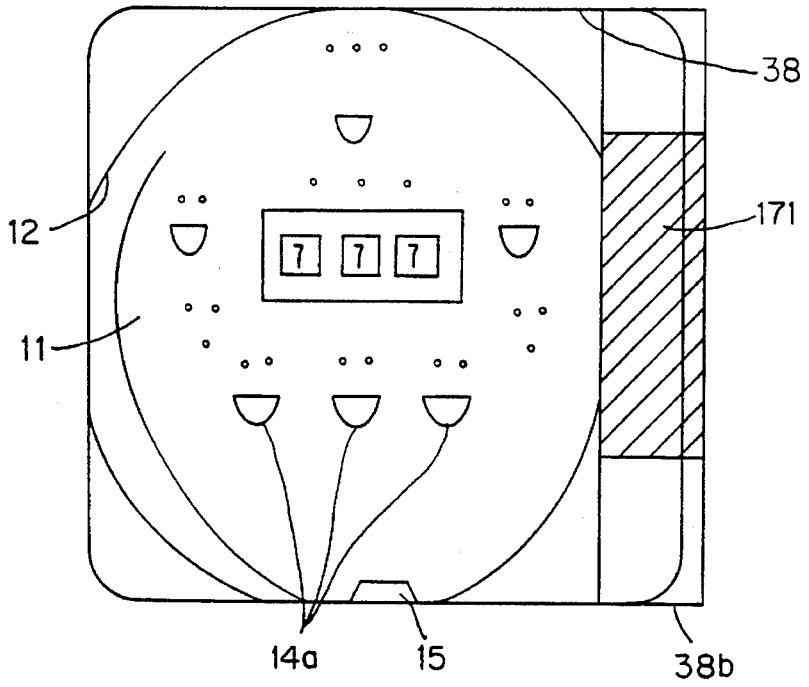
FIG. 17 is an explanatory view showing the outline of the second embodiment of a game machine of the present invention.

FIG. 17 shows the second embodiment of the present invention. In this embodiment, as depicted in FIG. 17, the matrix I/O sending/receiving board 171 is installed long sideways at a central portion of a side-end portion 38*b* of the mounting frame 38 where the panel 11 is not covered therewith (depicted as a shaded portion).

In this embodiment, since the matrix I/O sending/receiving board is not weighted with the sensing matrix 20, the vibration of the sensing matrix 20 is hardly transmitted and there is exerted no effect of the vibration to the signal sending/receiving. Besides, the position of the sensing matrix 20 in relation to the panel 11 can be adjusted within a range of 0~20 [mm] by moving the matrix I/O sending/receiving board 171 horizontally in the lower-end portion 38*a* of the mounting frame. Incidentally, since the metal body rarely comes toward the side-end portion 38*b* of the mounting frame 38 during the game playing, the matrix I/O sending/receiving board 171 is hardly subject to the vibration of the metal body.

Next, the third embodiment of the present invention will be described. The same parts and portions as those of the first embodiment have the same numeral and symbols assigned thereto, and shall not be repeatedly explained.

Figure 18:
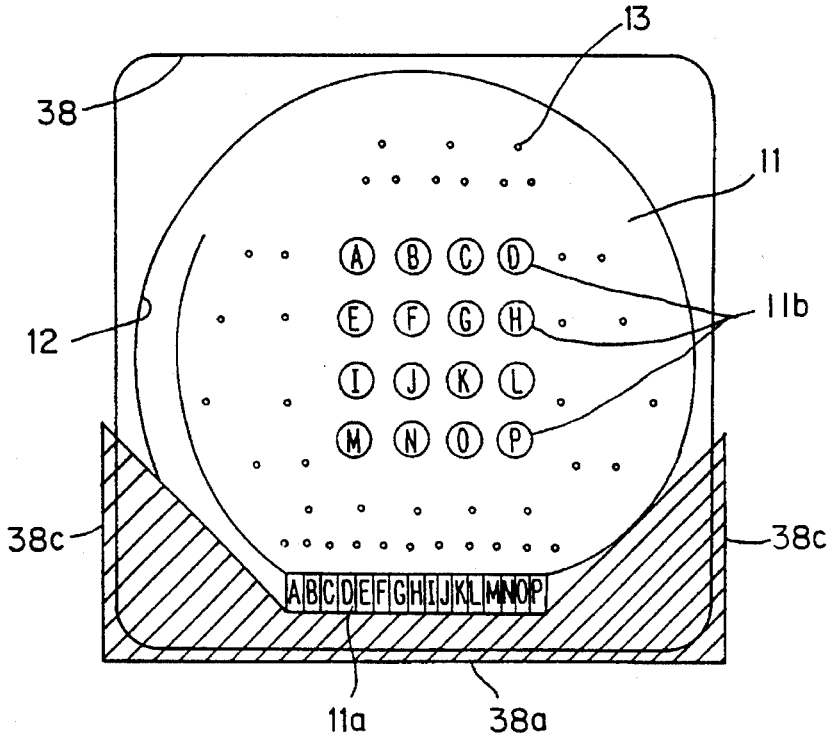
FIG. 18 is an explanatory view showing a general configuration of a third embodiment of a game machine of the present invention.

FIG. 18 shows the third embodiment of the present invention. As illustrated in FIG. 18, in this game machine, many pockets 11*a* for receiving the metal body are provided at the lower part of the panel 11 of the game machine of this embodiment. When the metal body entered into one of the pockets 11*a*, one of the sign lamps 11*b* corresponding to each of the pocket 11*a* turns on a light. The premium awarded to the combination of the lighted lamps is delivered.

The matrix I/O sending/receiving board 171 is installed at a position over the lower-end portion 38*a* and both of the lower-corners 38*c* of the mounting frame 38 where the panel 11 is not covered with the same (depicted as a shaded portion) in the present embodiment.

Since the greater part of the matrix I/O sending/receiving board 171 is provided at the lower-corners 38*c*, the part of the board 171 positioned at the area of the lower-end portion 38*a* can be reduced. Then, the height of the lower-end portion 38*a* can be lowered, so that it does not obstruct the game zone, such as the pockets 11*a* for receiving the metal body provided at the lower part of the panel 11 of the game machine. Incidentally, since the metal body rarely comes toward the sides of the both lower-corners 38*c* of the mounting frame 38 during the game playing, the matrix I/O sending/receiving board 171 is hardly subject to the vibration of the metal body.

Besides, the inner glass element whereupon the sensing matrix is provided is formed by two glass base plate in each of the above-mentioned embodiments. However, the present invention is not limited to it. For example, a glass base plate may alternatively be employed as the inner glass element. In this case, the signal sending lines are laid on one surface of the glass base plate, and the signal receiving lines are laid on the opposite surface of the glass base plate.

[Industrial Applicability]

The present invention is applicable to any of various game machines in which a metal body is moved along a panel.

We claim:

1. A game machine employing metal bodies as its media, which game machine comprises:

a panel having a plane providing a game zone in which said metal bodies move;

a cover element covering said panel with a fixed distance therebetween providing a space for the movement of metal bodies;

a mounting frame in which said panel and said cover element are mounted;

a matrix sensor comprising sensing units arranged in a matrix on the cover element for detecting the metal bodies without touching them; and a signal processing means which drives the matrix sensor and detects the location of the metal bodies on the panel; wherein a portion of said signal processing means is connected to said sensing matrix outside said game zone within a space defined by the mounting frame having upper and lower portions with side portions connected thereto by corner portions.

2. A game machine according to claim 1, wherein said signal processing means comprises a signal sending/receiving board having a signal sending circuit for sending signals to drive the sensing matrix and a signal receiving circuit for receiving signals form the sensing matrix.

3. A game machine according to claim 2, wherein said signal sending/receiving board is mounted on a lower portion of said mounting frame.

4. A game machine according to claim 2, wherein said signal sending/receiving board is mounted on a side portion of said mounting frame.

5. A game machine according to claim 2, wherein said signal sending/receiving board is mounted over two corner portions of said mounting frame.

6. The game machine according to claim 2, wherein said cover element has an outside glass element placed to form a surface of the game machine and an inner glass element placed between said outside glass element and said panel, said outside glass element and said inner glass element being mounted on the mounting frame with a space between said outside and inner glass elements.

7. A game machine according to claim 6, wherein said sensing matrix is provided on said inner glass element.

8. A game machine according to claim 7, wherein said signal sending/receiving board is arranged in said space between said outside glass element and said inner glass element.

9. A game machine according to claim 8, wherein said sensing matrix includes a plurality of signal sending lines arranged in parallel and folded-back formation and a plurality of signal receiving lines arranged in parallel and folded-back formation, said signal sending lines and said signal receiving lines arranged in intersecting directions with the inner glass element therebetween, to form sensing units at the intersections of the signal sending lines and signal receiving lines.

10. A game machine according to claim 9, wherein said inner glass element includes a first and a second glass plate constituting said inner glass plate, and said signal sending liens and said signal receiving lines are laid on opposite outer surfaces of said first and second glass plates layered on each other in the intersecting directions with said first and second glass plates therebetween.

11. A game machine according to claim 10, comprising protective sheets on the signal sending lines and the signal receiving lines.

12. A game machine according to claim 9, further comprising a signal sending connector connected to the signal sending liens, a signal receiving connector connected to the signal receiving lines, and a connector-mounting plate on which said connectors are fixed, the connector-mounting plate being installed at a lower corner portion of said inner glass plate.

* * * * *